United States Patent [19]

Masel et al.

[11] Patent Number: 4,609,333

[45] Date of Patent: Sep. 2, 1986

[54] SYSTEM FOR HANDLING PRESSURIZED FLUIDS

[75] Inventors: Ruben Masel, Kiron; George Valdshtein, Holon, both of Israel

[73] Assignee: Koor Metals Ltd., Holon, Israel

[21] Appl. No.: 699,142

[22] Filed: Feb. 7, 1985

[30] Foreign Application Priority Data

Feb. 24, 1984 [IL] Israel ..... 71058

[51] Int. Cl.[4] ..... F04B 43/06

[52] U.S. Cl. ..... 417/393; 122/13 R; 137/99

[58] Field of Search ..... 122/13 R, 13 A, 406 R; 417/393, 395, 323, 39, 40; 137/99, 389, 409

[56] References Cited

U.S. PATENT DOCUMENTS 1,164,926 12/1915 Clark ..... 417/393
1,346,898 7/1920 Kingsbury ..... 417/36 X
2,296,034 9/1942 Hemming et al. ..... 137/389 X
3,192,865 7/1965 Klempay ..... 417/395 X
3,282,468 11/1966 Karlen ..... 137/565 X
4,437,484 3/1984 Laing et al. ..... 137/99

*Primary Examiner*—Leonard E. Smith
*Attorney, Agent, or Firm*—Benjamin J. Barish

[57] ABSTRACT

Method and apparatus are described for handling a pressurized fluid inletted from a pressurized fluid supply line into a container and outletted therefrom through a pressurized outlet line in order to avoid pressurizing the container. According to the described method and apparatus, the energy of the fluid inletted from the pressurized fluid supply line into the container is utilized for driving a motor, thereby reducing the pressure of the fluid stored in the container; and the motor is utilized for driving a pump which increases the pressure of the fluid outletted from the container to the pressurized fluid outlet line. The invention is described particularly with respect to hot water supply systems in order to avoid the need of making the storage tank of pressurized construction.

12 Claims, 13 Drawing Figures

SYSTEM FOR HANDLING PRESSURIZED FLUIDS

BACKGROUND OF THE INVENTION

The present invention relates to a system for handling pressurized fluids. The invention is particularly useful in hot water supply systems, and is therefore described below with respect to this application.

Hot-water supply systems conventionally include a storage tank of a pressurized construction capable of withstanding a very high pressure. This is because the pressure of the cold water supply line is used for outletting the hot water which is supplied whenever the hot water tap is opened. For example, if the pressure of the supply line is from 3–8 atmospheres, the storage tank must be constructed to withstand a pressure of up to about 12 atmospheres for safety purposes. Such pressurized tank constructions require special materials, seals, safety valves, and the like, which requirements make pressurized tanks extremely expensive to manufacture and to maintain.

An object of the present invention is to provide a system, for handling a pressurized fluid inletted into a container and to be outletted therefrom in a manner such as to avoid the the necessity of pressurizing the container, thereby enabling the container to be constructed and maintained at considerably less expense than the presently used pressurized container constructions. The invention is particularly suitable for use in hot water supply systems, in order to avoid the neccessity of making the hot water supply tank of a pressurized construction, but it will be appreciated that the invention could be used in many other applications involving pressurized fluids, for example in heat-exchangers, filters, and the like.

SUMMARY OF THE INVENTION

According to the present invention, there is provided a fluid handling system comprising a container including an inlet connectable to a pressurized fluid supply line and an outlet connectable to a pressurized fluid outlet line including a control valve. The system includes a pressure-booster having a motor driven by the inletted fluid when the control valve is open to thereby decrease the pressure of the fluid within the container, and a pump driven by the motor to pump out the fluid from the container at a higher pressure than the pressure of the fluid within the container. The novel system is generally characterized by the following features: (1) the pressure-booster includes a diaphragm seal positively sealing the inletted fluid from the outletted fluid; (2) the pump has a greater displacement than the motor such that the operation of the pressure-booster tends to deplete the container; (3) and the system further includes a bypass from the pressurized fluid supply line to the interior of the container bypassing the pressure-booster for replenishing the fluid in the container.

Several embodiments of the invention are described below for purposes of example, in these embodiments, the motor drives a reciprocating member through forward and return strokes, which reciprocating member in turn drives the pump through forward and return strokes, and also reverses the fluid flow through the motor and pump at the end of each stroke.

Further features and advantages of the invention will be apparent from the description below.

BRIEF DESCRIPTION OF THE DRAWINGS

The invention is herein described by way of example only, with reference to the accompanying drawings, wherein.

DESCRIPTION OF PREFERRED EMBODIMENTS

Figure 1:
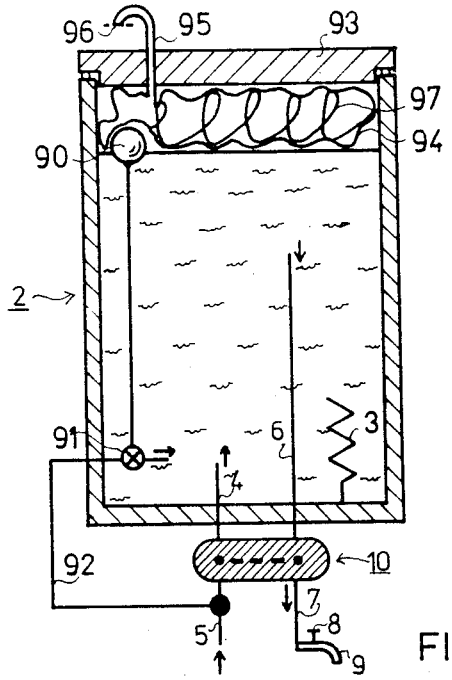
FIG. 1 is a diagram illustrating one form of system for storing and demand-supplying pressurized fluid in accordance with the present invention.

The hot water supply system illustrated in FIG. 1 comprises a hot water tank, generally designated 2, including an electrical heater unit 3 for heating the water within the tank, a cold water inlet 4 and a hot water outlet 6. The hot water is supplied, via a line 7 and control valve 8, to a faucet 9 or other consumer devices. As indicated earlier, normally such a hot water tank is of pressurized construction in order to provide the hot water at outlet 6, which is supplied at substantially the same pressure as that of the cold water supply line connected to the cold water inlet 4. For example, if the line pressure is about 3–5 atmospheres, the tank 2, in order to meet safety requirements, would have to withstand pressures of approximately 12 atmospheres or more. Such a pressurized tank construction requires materials, (e.g. steel) of special quality, joints (e.g. weldings) produced under careful control, and relief valves for safety purposes, all of which make the tank very costly to construct and to maintain.

According to the present invention, the hot water tank 2 need not be of a pressurized construction, since it stores the water at approximately atmospheric pressure. Thus, tank 2 can be produced of thin galvanized steel, polyurethane or other plastic material, asbestos cement, or other inexpensive material which permits the tank to be manufactured and maintained at a small fraction of the cost of a pressurized tank. Briefly, this is accomplished by utilizing the energy of the cold water inletted from the pressurized cold water supply line 5 into the tank 2 for driving a motor, thereby reducing the pressure of the liquid received within the tank; and utilizing the motor for driving a pump which increases the pressure of the hot water outletted from the tank via its outlet 6. Both the foregoing motor and pump are included in drive unit generally designated 10 in FIG. 1, and more particularly illustrated in FIGS. 2–5. Such a motor-pump unit thus recuperates or restores at the hot water outlet, the pressure of the inlet supply, line and therefore can be called a hydro-recuperator.

Figure 2:
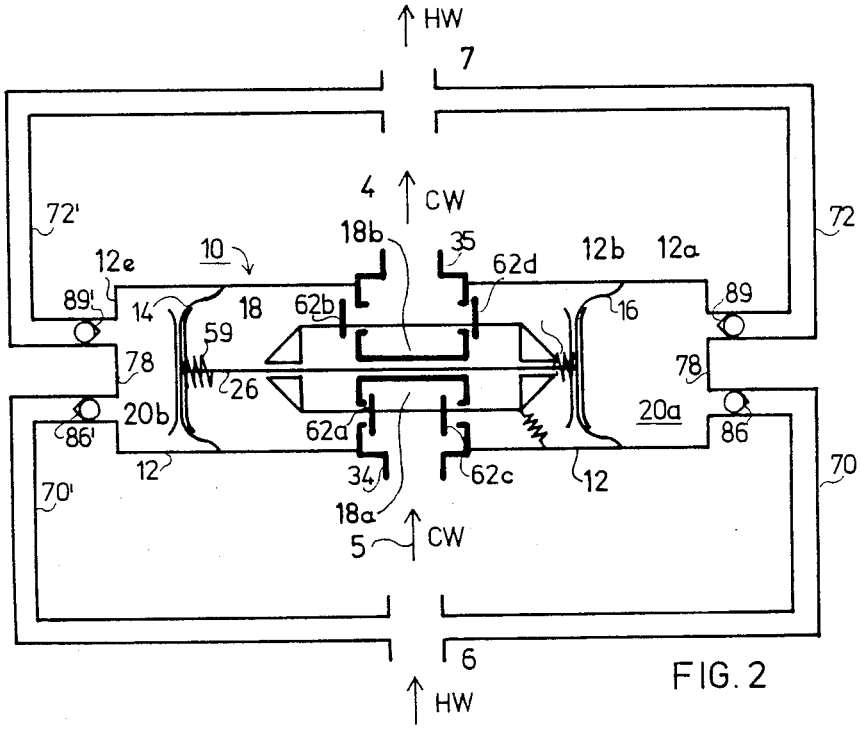
FIG. 2 is a diagram schematically illustrating one form of motor and pump unit that may be used in the system of FIG. 1.

FIG. 2 diagramatically illustrates the construction of the motor-pump unit 10. It comprises a common housing 12 divided by a pair of diaphragms 14 and 16 into a plurality of chambers, namely a central chamber 18 between the two diaphragms, and a pair of end chambers 20*a*, 20*b* on the opposite sides of the two diaphragms. Chamber 18 serves as a motor chamber, in that it utilizes the energy of the cold water inletted via the supply line 5 to drive the diaphragms 14, 16 in a manner to be described below, thereby also reducing the pressure of the cold water received within the tank inlet 4; and chambers 20*a*,20*b* are pump chambers in that, in these chambers, the hot water outletted from the hot water outlet 6 of the tank 2 is subjected to an increase in pressure by the diaphragms 14, 16 as the hot water is supplied to the hot water supply line 7.

Figure 3:
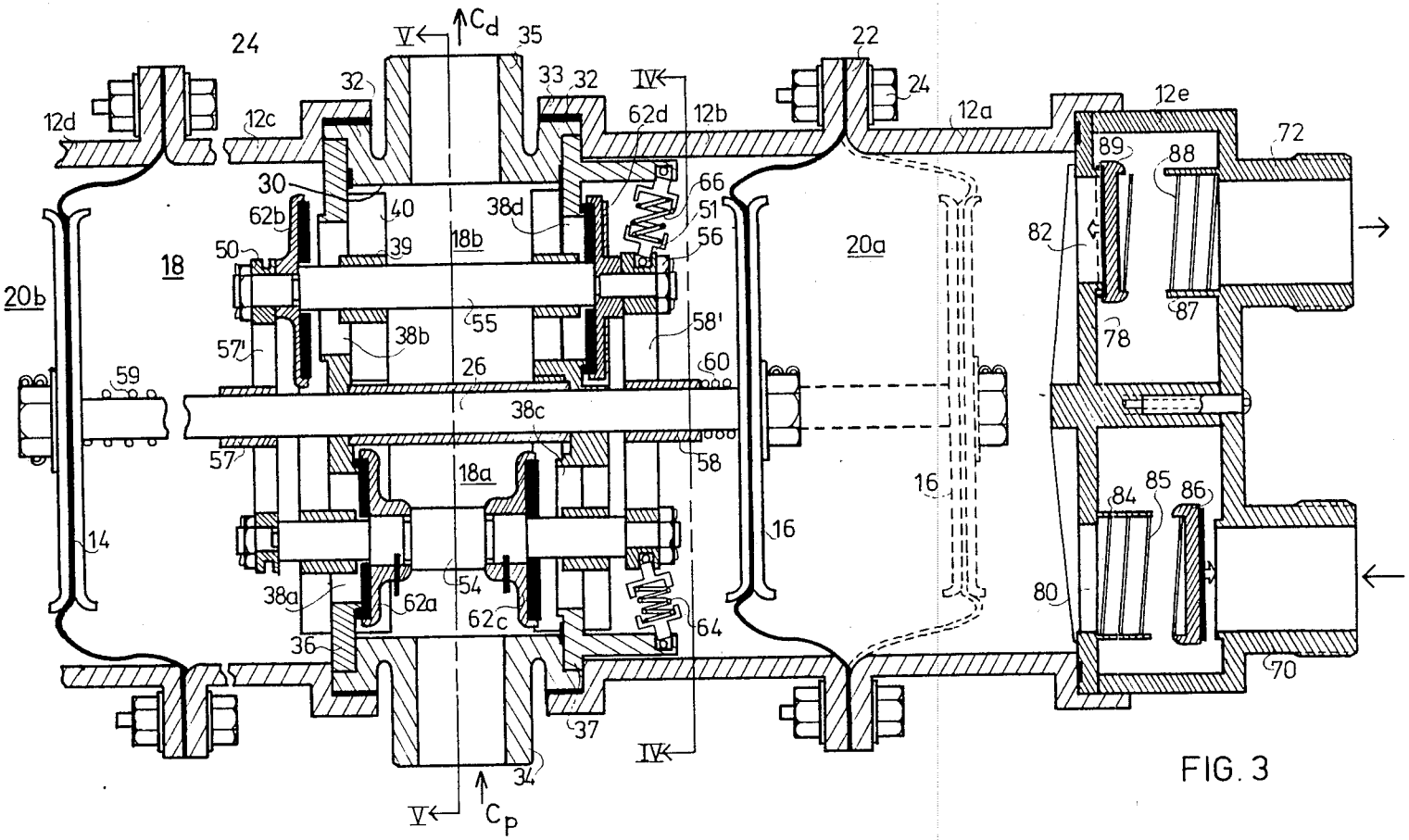
FIG. 3 is a fragmentary sectional view more particularly illustrating the construction of the motor-pump unit of FIG. 2.
Figure 4:
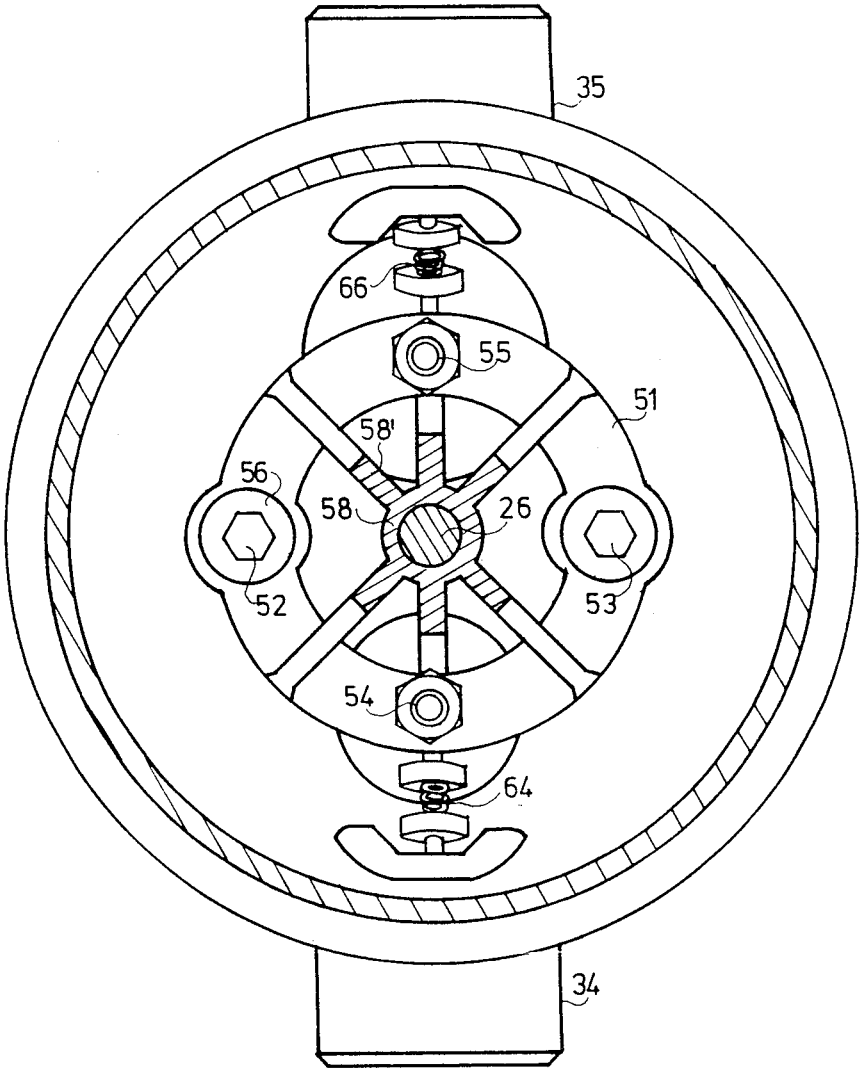
FIG. 4 is a transverse sectional view along lines IV—IV of FIG. 3.
Figure 5:
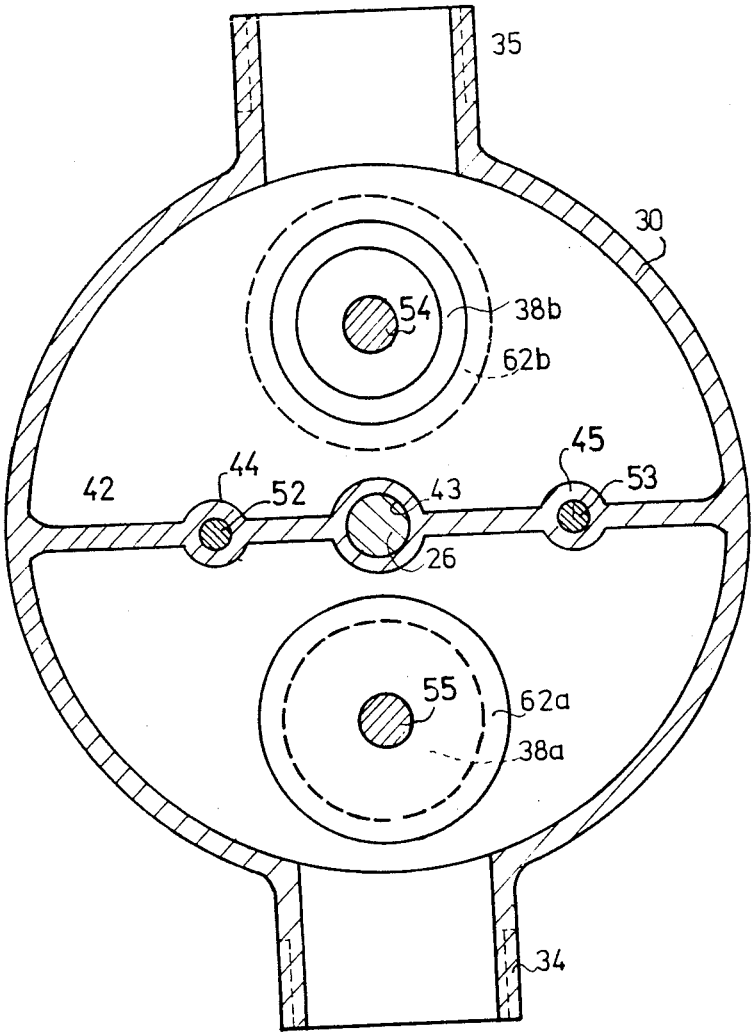
FIG. 5 is a transverse sectional view along lines V13 V of FIG. 3.

More particularly, housing 12 of the motor-pump or hydro-recuperator, unit 10 includes, at one end, a pair of annular sections 12*a*, 12*b* (FIG. 3) having annular flanges secured together by bolts 22 between which is also secured the periphery of diaphragm 16, and at the opposite end, another corresponding pair of annular sections 12*c*,12*d* also having flanges secured together by bolts 24 with the periphery of diaphragm 14 secured between them. The two diaphragms 14, 16 are connected by a shaft 26 extending through the motor section of the unit so that the two diaphragms move together. The housing 12 further includes end sections 12*e* at its opposite ends (only the right end is seen in FIG. 3).

Disposed within the motor section of housing 12 is a valve assembly comprising a fixed section including valve openings, and a movable section carrying the valve members which open and close the valve openings in order to effect the reciprocation of the two diaphragms 14,16.

The fixed section of the valve assembly comprises an outer tube 30 having an axially-extending flange 32 at its opposite ends formed with threads engageable with flanges 33 on the housing sections 12*b* and 12*c*. Tube 30 is further formed with an inlet fitting 34 for inletting pressurized cold water into the motor chamber 18, and an outlet fitting 35 for outletting the depressurized water from the motor chamber.

The fixed section of the valve assemby further includes a pair of end walls 36 and 37 each formed with a pair of valve openings on opposite sides of shaft 26 connecting the two diaphragms 14, 16 together. Thus, end wall 36 is formed with the two openings 38*a*, 38*b* and end wall 37 is formed with the two openings 38*c*,38*d*. A tubular guide 39 is supported by a plurality of spider arms 40 centrally of each opening.

The outer tube 30 of the fixed section of the valve assembly further includes a partition plate 42 (see FIG. 5) extending diametrically across the tube 30 and dividing that partion of the pump chamber 18 into two separate compartments 18*a*, 18*b*. Partition 42 is formed with a central bore 43 for accomodating shaft 26 connecting together the two diaphragms 14, 16. In addition, partition plate 42 is formed with two further bores 44, 45 accommodating bolts in the movable section of the valve assembly, as will be described more particularly below.

The movable section of the valve assembly comprises two end rings 50, 51 each formed with four equally-spaced openings for receiving four bolts 52–55. Bolts 52 and 53 extend through bores 44 and 45 of the partition plate 42; bolt 54 extends through the tubular guides 39 located centrally of the valve openings 38*a*, 38*c* of the two end plates 36, 37 respectively, of the fixed section of the valve assembly; and bolt 55 extends through the tubular guides 39 located centrally of valve openings 38*b*, 38*d* of the same two end walls. All the bolts are secured by means of nuts 56.

The movable section of the valve assembly further includes tubular guides 57, 58 each connected to one of the end rings 50, 51 by means of spider arms 57', 58'. The two tubular guides 57, 58 are aligned with the central bore 43 formed in the partition plate 42 and also receive the shaft 26 connecting together the two diaphragms 14, 16. Tubular guides 57, 58 project past their respective end rings 50, 51 as shown particularly in FIG. 3. A coiled spring 59, 60 is provided at each end of shaft 26 connecting together the two diaphragms 14, 16, each spring being interposed between the respective diaphragm and the outer end of the respective tubular guide 57 or 58.

The two bolts 54, 55 passing through the valve openings 38*a*–38*d* carry the valve members cooperable with these valve openings. Thus, the lower bolt 54 carries a valve disc 62*a* at one end cooperable with valve opening 38*a*, and a valve disc 62*c* at the opposite end cooperable with valve opening 38*c*. As shown in FIG. 3, both of these valve discs are disposed to cooperate with the inner side of each of these valve openings, and are located so that when bolt 54 is in one position wherein its valve disc 62*a* closes valve opening 38*a* (the position illustrated in FIG. 3), its other valve disc 62*c* opens its respective valve opening 38*c*, and vice versa.

Bolt 55 similarly carries the two valve discs cooperable with valve openings 38*b* and 38*d*, but here the valve discs are disposed at the outer ends of the two valve openings. As in the case of the previously described valve discs 62*a*, 62*c* carried by bolt 54, valve discs 62*b* and 62*d* are carried by their bolt 55 such that when valve opening 38*b* is opened by its valve disc 62*b*, valve opening 38*d* is closed by its disc 62*d*.

It will thus be seen that the valve discs 62*a*–62*d* are part of a movable section (also including the end tubular guides 57, 58 and the end rings 50,51 all coupled together by the four bolts 52–55) of the valve assembly, which movable section is shiftable as a unit to cause the valve discs 62*a*–62*d* to uncover or cover their respective valve openings 38*a*–38*d* of the fixed section of the valve assembly. This movable section of the valve assembly further includes a pair of over-center spring devices 64, 66 at one end interposed between notches formed in the outer tube 30 of the fixed valve assembly section and annular ring 51 of the movable valve assembly section. The over-center spring devices 64, 66 have the function of causing the movable section to assume either one of two stable states and to impart a snap-action to the movable section when it is moved from one state to the other. The actuation of the movable section is effected at the end of the stroke of the diaphragms 14, 16, and the two coil springs 59, 60 serve to provide a bias to the movable valve section to prevent its stopping at a dead-center position with respect to the over-center spring devices 64,66 all as will be described more fully below.

End section 12*e* at the right end of hydro-recuperator unit housing 12 is formed with a pair of fittings 70, 72. Fitting 70 is adapted to be coupled to the hot water outlet 6 (FIG. 1) of tank 2, and fitting 72 is adapted to be coupled to the hot water output line 7, the latter supplying hot water to faucet 9 or other device (e.g., shower head) on demand under the control of valve 8.

A disc 78 is provided at each end section 12*e* and is secured between it and the adjoining housing sections 12*a*, 12*d*, respectively. The two discs 78 thus define the outer ends of the two pump chambers 20*a*,20*b*, the inner ends of these chambers being defined by the reciprocating diaphragms 14, 16. Each end disc 78 is formed with a pair of openings 80, 82 aligned with the inlet and outlet fittings 70, 72, for the hot water.

Opening 80 in end disc 78 is circumscribed by a shroud 84 receiving a coiled spring 85 between it and a valve member 86, which spring biasses the valve member to close the opening within the inlet hot water fitting 70. Valve member 86 thus functions as a one-way valve permitting the hot water to flow via inlet fitting 70 only in the inward direction, i.e., into the pump chamber 20*a*.

A similar one-way valve is provided in the outlet fitting 72. Thus, a shroud 87 circumscribes the opening formed in that fitting and receives a coil spring 88 biassing a valve member 89 in the direction of closing opening 82 in end disc 78. Valve member 89 thus serves as a one-way valve permitting flow only in the direction from pump chambers 20*a* through the outlet fitting 72.

It will be appreciated that the opposite end of the hydro-recuperator unit housing 12 is similarly provided with a hot water inlet fitting 70' controlled by a one-way valve 86', and a hot water outlet fitting 72' controlled by a one-way valve 89', cooperable with the pump chamber 20*b* at the other end of the housing, as shown in FIG. 2.

The system illustrated in the drawings, as shown particularly in FIG. 1, further includes a liquid-level control for maintaining a pre-determined level of hot water within tank 2. This liquid-level control includes a float 90 which operates a valve 91 to control the flow of water from the pressurized cold water line 5 into the tank via a conduit 92 by-passing the hydro-recuperator unit 10, to provide make-up water, for a reason to be described more particularly below.

The hot water tank 2 need not be pressurized, as described above, and may therefore be uncovered. However, to prevent any contamination entering the water within the tank, it is preferred to provide a cover 93 over the top of the tank, and to include an inflatable bag 94 floating on top of the water within the tank. Inflatable bag 94 is provided with a breather tube 95 extending through an opening in the top cover 93 and exposed to the atmosphere. Thus, inflatable bag 94 vents the interior of the tank 2 to the atmosphere while at the same time it, and cover 93, prevent external contamination of the water within the tank. Preferably, a filter, schematically indicated at 96 in FIG. 1, covers the opening of breather tube 95 to prevent foreign particles from entering the inflatable bag 94. The latter bag may include a coil spring 97 or other means within it to prevent its sides from sticking together when fully deflated, which might interfere with the inflation of the bag via breather tube 95 upon changes in liquid level within the tank 2.

The system illustrated in the drawings operates as follows: First, it will be assumed that the control valve 8, which is opened whenever pressurized hot water is to be supplied to the faucet 9, is in its closed condition, and that the parts of the hydro-recuperator unit 10 are in the positions illustrated in FIGS. 2 and 3. In this position, the diaphragms 14 and 16 are at their end of stroke travel in one direction, wherein chamber 20*b* is contracted and chamber 20*a* is expanded. In this illustrated position, diaphragm 16, via its coil spring 60, has just shifted the movable valve section of the valve assembly within the motor chamber 18, such that: in the inlet compartment 18*a* of the motor chamber, valve disc 62*a* is closed with respect to its opening 38*d*, and valve disc 62*c* is open with respect to its opening 38*c*; and in the outlet compartment 18*b* , valve disc 62*b* is open with respect to its opening 38*b*, and valve disc 62*d* is closed with respect to its opening 38*d*. Thus, the pressurized water from the cold water supply line 5 is applied via inlet fitting 34 and open valve 38*c* to diaphragm 16 tending to contract pump chamber 20*a*, and the outlet fitting 35 connected to the cold water inlet 4 of the hot water tank 2 communicates with diaphragm 14 tending to expand the pump chamber 20*b*.

Now, as soon as control valve 8 (FIG. 1) is turned-on in order to supply pressurized hot water from tank 2, to faucet 9, the flow of hot water via outlet fitting 72 permits diaphragm 16 to move under the flow of the pressurized cold water via inlet 34. Diaphragm 16 is thus driven by the pressure of the cold water supply line to contract pump chamber 20*a* and to force the pressurized water through the outlet fitting 72. Shaft 26, which couples diaphragm 16 to diaphragm 14, causes the latter diaphragm also to move in the same direction, causing the cold water within the motor compartment 18*b* to be exhausted via outlet fitting 35 into the tank 2 at atmospheric pressure, while pump chamber 20*b* is expanding and thereby draws hot water at atmospheric pressure via the hot water outlet 6 of the tank and the one-way valve 89'.

The pressurized cold water supply line 5 thus drives both diaphragms 16 and 14 rightwardly to pump pressurized hot water from chamber 20*a* via the hot water outlet port 72, while chamber 20*b* is refilled with hot water at atmospheric pressure from tank 2. This action continues until the end of the stroke of the two diaphragms 14, 16, whereupon diaphragm 14, via its spring 59 acting against the end of tube 57 of the movable section of the valve assembly, shifts the valve assembly rightwardly, thereby reversing the conditions of the four valve members 62*a*–62*d* of that assembly. This reversal of the valve conditions causes the pressurized cold water inletted via the pressurized cold water supply line 5 to drive the two diaphragms 14 and 16 in the opposite direction, contracting pump chamber 20*b* and expanding pump chamber 20*a*, so that the hot water is now driven, under pressure, via one-way valve 89' and outlet fitting 72', while pump chamber 20*a* is refilled with unpressurized water via inlet fittings 86 and one-way valve 70.

The reversal of the movement of the valve assembly at the end of the stroke of the diaphragms 14, 16, is enhanced by the over-center spring devices 64,66, which provide a snap-action movement to the valve assembly when shifting from one direction to the other. The coil springs 59 and 60 provide a bias to the two diaphragms 14, 16, to start its movement should the control valve 76 be turned-off when the diaphragms are in a dead-center position.

It will thus be seen that the pressurized cold water of the cold water supply line is used in unit 10 to drive the diaphragms 14 and 16, thereby dropping the pressure of the cold water inletted via inlet 4 into the tank 2 to substantially atmospheric pressure, while the energy thus applied to the diaphragms is used to increase the pressure of the hot water supplied from outlet 6 of the tank to the consumer via the hot water outlet 7.

The hydro-recuperator or motor-pump unit 10 will involve some volumetric losses and for this reason the volume of the motor section is less than the volume of the pump section, e.g., by the volume taken up by the shaft 26, the partition plate 42, and the four bolts 52–55; also, the tank 2 includes a liquid-level detector in the form of a float 95 controlling a valve 96 to supply make-up water to the tank via conduit 97 which by-passes the hydro-recuperator unit 10. While this pressure loss will also tend to produce a slight decrease in the pressure of the hot water outletted from unit 10, this pressure loss will be inconsequential and will probably even go unnoticed in most cases by the consumer.

Figure 6:
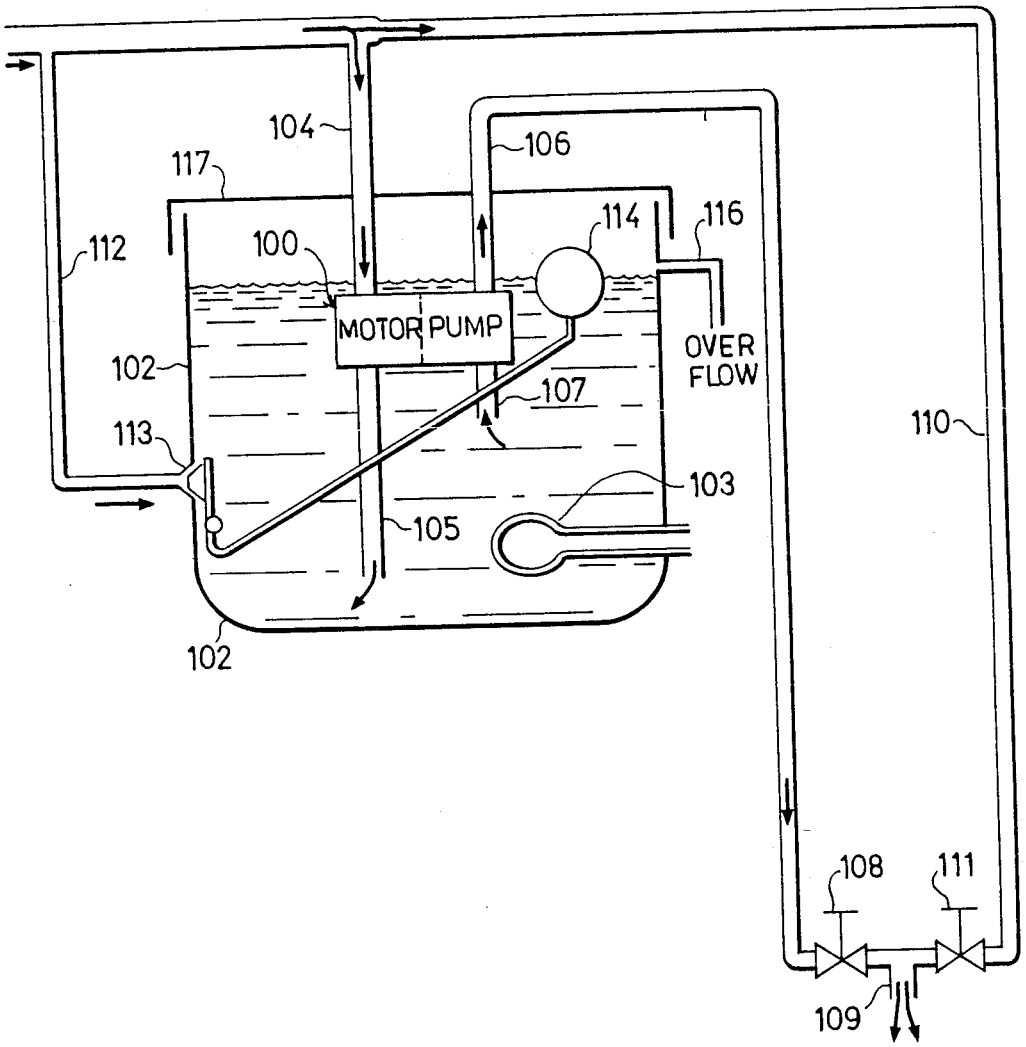
FIG. 6 is a diagram illustrating another system for storing and demand-supplying pressurized fluid in accordance with the present invention.

FIG. 6 illustrates another form of hot-water supply system in which the motor-pump unit, therein generally designated 100, is submerged within the hot-water tank 102, the latter also including an electrical heater 103. Thus, the motor-pump unit 100 includes a pressurized cold-water inlet 104, an unpressurized cold-water outlet 105, a pressurized hot-water outlet 106, and an unpressurized hot-water inlet 107. The pressurized water is supplied via a control valve 108 to a faucet 109, the faucet also being supplied with pressurized cold water via a conduit 110 and a control valve 111.

The system illustrated in FIG. 6 further includes a by-pass conduit 112 controlled by a valve 113 which is operated by a float 114 to supply make-up water to the tank whenever needed to maintain a constant level. The tank further includes an overflow 116 in case of malfunction of the float-operated valve 113, and a lid 117 to keep out dirt particles.

Figure 7:
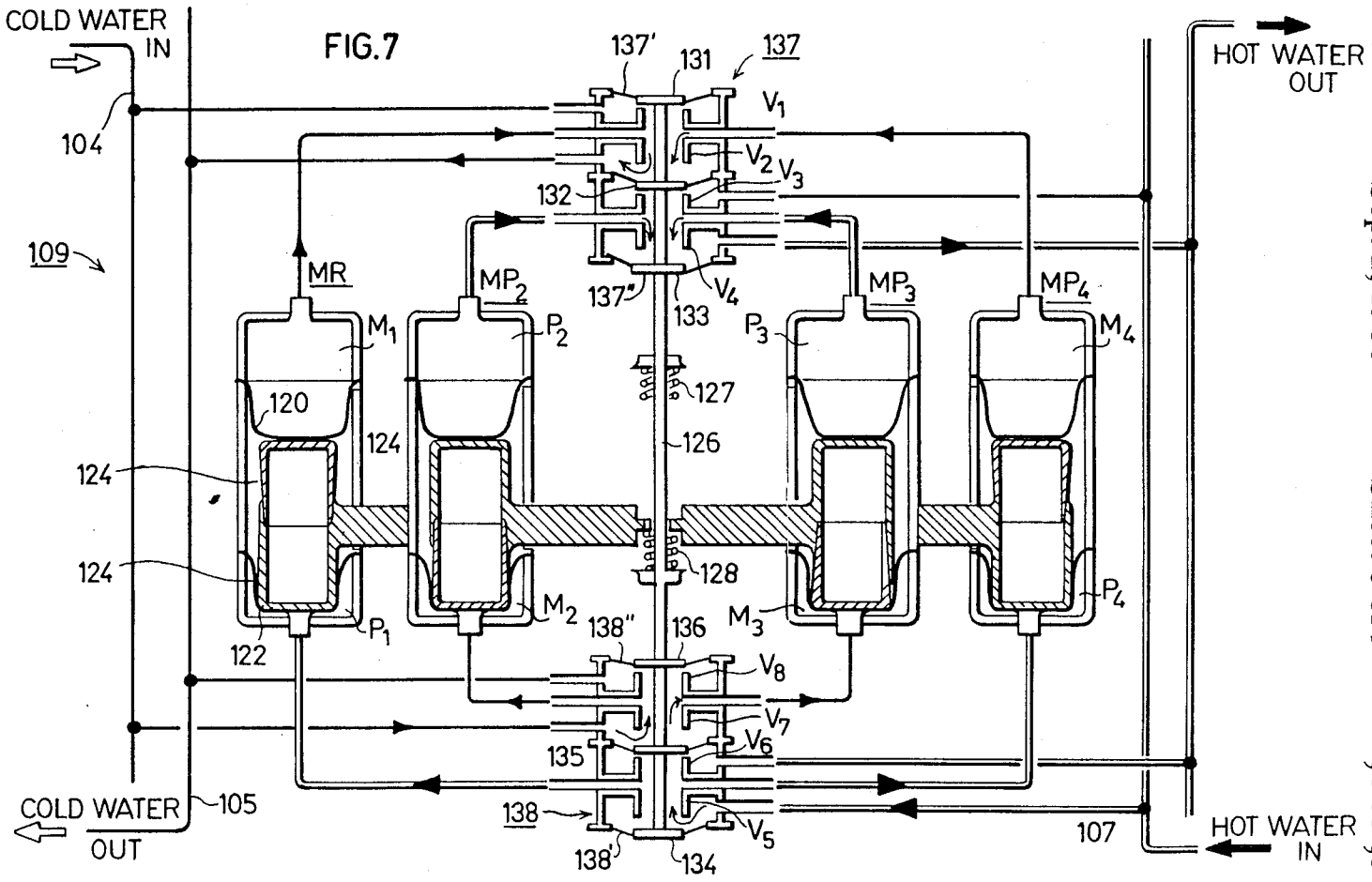
FIG. 7 is a diagram schematically illustrating the motor-pump unit which may be used in the system of FIG. 6.
Figure 8:
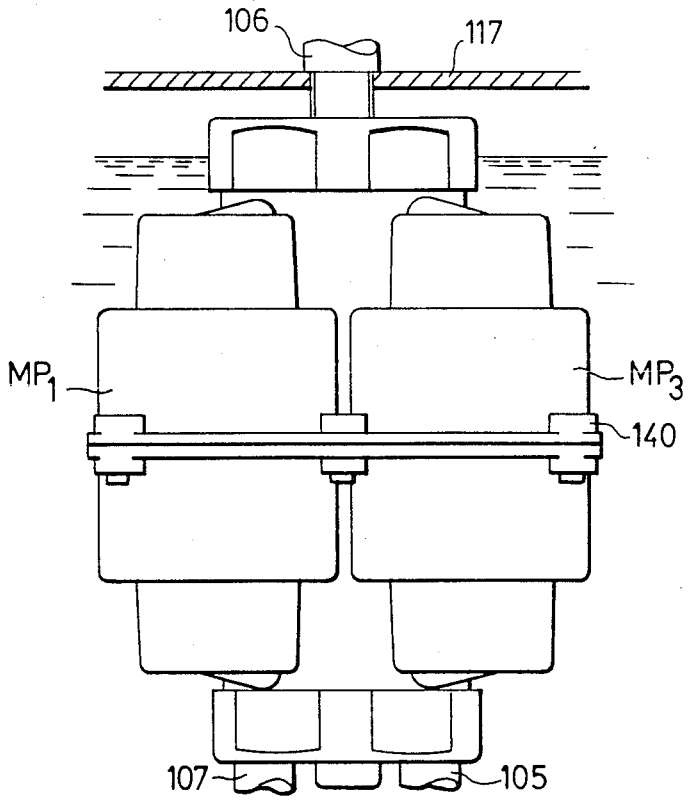
FIG. 8 is a side elevational view illustrating the motor-pump unit in the system of FIGS. 6 and 7.
Figure 9:
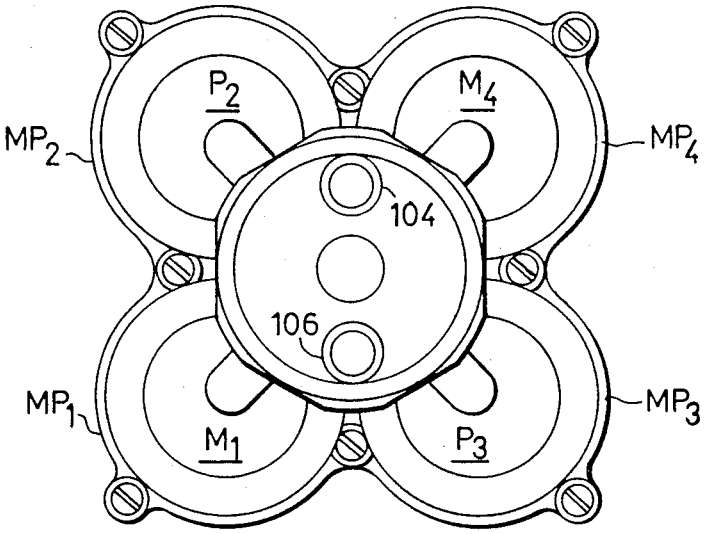
FIG. 9 is a top plan view of the motor-pump unit of FIG. 8.
Figure 10:
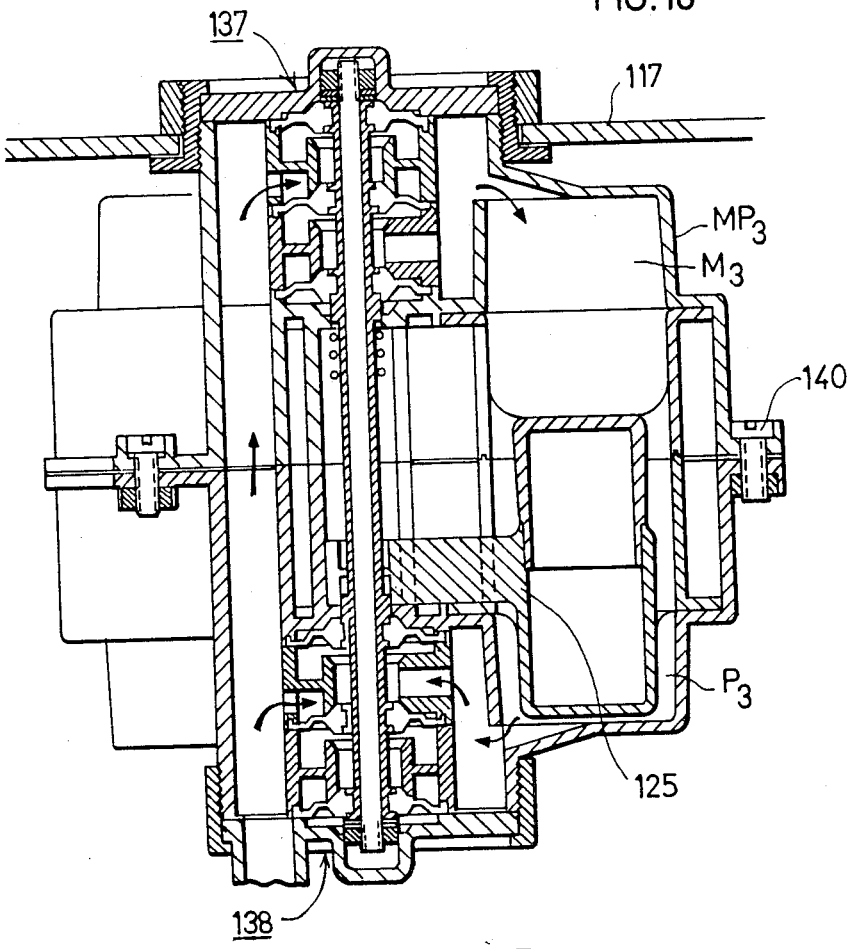
FIG. 10 is a partial longitudinal sectional view of the motor-pump unit of FIG. 8 to show internal structure.

The motor-pump unit 100 illustrated in the system of FIG. 6 is more particularly shown in FIGS. 8–11, but its construction and mode of operation will be better understood by first referring to the schematic diagram of FIG. 7.

Thus, the motor-pump unit 100 comprises four cylinders, each serving as a motor-pump and therefore designated in FIG. 7 as $MP_1$–$MP_4$. Each cylinder includes two diaphragms 120, 122 dividing the interior into a motor chamber and a pump chamber. Thus, the upper parts of the two outside cylinders $MP_1$–$MP_4$ serve as motor chambers and are therefore designated $M_1$,$M_4$, respectively, and their lower parts serve as pump chambers and are therefore designated $P_1$, $P_4$, respectively; whereas in the two inner cylinders $MP_2$,$MP_3$, the arrangement is reversed, the upper parts of the cylinders serving as pump chambers as indicated at $P_2$,$P_3$, and their lower parts serving as motor chambers $M_2$,$M_3$.

Each of the four cylinders $MP_1$–$MP_4$ further includes a plunger 124 interposed between the two diaphragms 120, 122, in the respective cylinder, all four system plungers being connected together as shown at 125 and being coupled to a reciprocating rod 126 via a pair of springs 127, 128, such that all the plungers 124 move together with the reciprocation of rod 126.

As seen in FIG. 7, the volume of the motor plungers, designated 124$_m$, in all four cylinders $MP_1$–$MP_4$, is slightly smaller than this volume of the pump plungers 124$_p$, such that the pump plungers deliver more (about 5% more) hot water than the entering cold water, as in the previously-described embodiment. The flow-operated valve 113 supplies the required make-up water to maintain the water level in tank 102.

Also coupled to reciprocating rod 126 are six valve members 131–136 for controlling eight valves $V_1$–$V_8$, which valves control the flow of the water into and out of the motor and pump chambers of the cylinders $MP_1$–$MP_4$. As seen in FIG. 7, the eight valves are divided into two groups, namely: a first group consisting of valve $V_1$–$V_4$ included within a valve unit 137 at one end of reciprocating rod 126; and a second group consisting of valves $V_5$–$V_8$ included within a second valve unit 136 at the opposite end of the reciprocating rod. Valve unit 137 is sealed at its opposite ends by diaphragm 137' between one end valve member 131 and the valve housing, and diaphragm 137'' between the other end valve member 133 and the valve housing. Valve unit 138 is similarly sealed at its opposite ends by diaphragms 138' and 138''.

As also seen in FIG. 7, the pressurized cold-water inlet is connected to valves $V_1$ and $V_7$; the unpressurized cold-water outlet 105 is connected to valves $V_2$ and $V_8$; the unpressurized hot-water inlet is connected to valves $V_3$ and $V_5$; and the pressurized hot-water outlet 106 is connected to valves $V_4$ and $V_6$.

Figure 11:
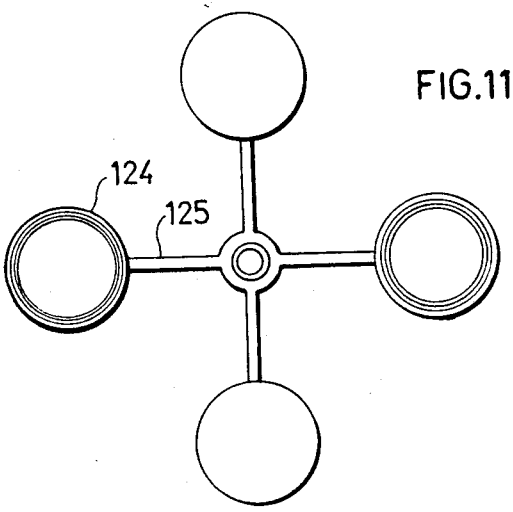
FIG. 11 is a top plan view of the 4-plunger assembly in this unit of FIG. 8.

As shown in FIGS. 8–11, the four cylinders $MP_1$–$MP_4$ are fixed in a circular array by a clamp 140, with the reciprocating rod 126 passing through the center of the array. The common coupling member 125 connecting all the plungers 126 such that they all move together would therefore be of annular shape, as shown in FIG. 11. From FIG. 9, it is seen that the two cylinders $MP_1$, $MP_4$ having their motor compartments $M_1$, $M_4$ at their upper ends, are disposed in diagonal relationship to each other, as are the remaining two cylinders $MP_2$, $MP_3$, having their pump compartments $P_2$, $P_3$ at their upper ends. Such an arrangement produces a balance of forces, thereby insuring more quiet and stress-free operation during the reciprocation of rod 126 and the plungers 124 coupled to that rod.

During each reciprocation of rod 126, two of the eight chambers defined by the four cylinders $MP_1$–$MP_4$ will always be filled with pressurized cold water from the cold-water supply line 104; two chambers will outlet unpressurized cold water via outlet 105 to the tank 102; two chambers will draw in unpressurized hot water from the hot-water inlet 107; and two chambers will pump out pressurized hot water via the hot-water outlet 106. In each case the two chambers involved are at diagonally-opposite sides of the motor-pump unit 100 so as to produce the above-mentioned balance of forces. It will be appreciated that the motor-pump unit 100 operates only when the hot-water tap 108 is open. The frequency at which rod 126 reciprocates can be preset according to the parameters of the system, a preferred frequency being 60 cycles per minute.

The system illustrated in FIGS. 6–11 operates as follows, reference being made particularly to the schematic diagram of FIG. 7.

FIG. 7 illustrates the condition of the motor-pump unit 100 wherein valves $V_2$, $V_4$, $V_5$, and $V_7$ are open, the remaining valves being closed. Thus, the pressurized cold water is supplied from line 104 via open Valve $V_7$ to the two motor chambers $M_2$, $M_3$, disposed in diagonal relationship to each other, thereby driving the pistons in cylinders $MP_2$, $MP_3$ upwardly to pump the hot water (previously introduced into the piston compartments $P_2$, $P_3$) via open valve $V_6$ to the pressurized hot water outlet 106. Since the plungers 124 of all four cylinders are coupled together via coupling member 125, the pistons in the other two cylinders $MP_1$, $MP_4$, are also driven upwardly, whereby the cold water previously introduced into compartment $M_1$ is exhausted via open valve $V_5$ to the unpressurized cold-water outlet 105; and unpressurized hot water from line 107 is drawn via open valve $V_5$ into the pump chamber $P_4$ of cylinder $MP_4$.

At the completion of this reciprocating stroke, the valve connections are reversed, so that valves $V_2$, $V_4$, $V_5$, and $V_7$, which were open during the previous stroke, are now closed, and the four other valves, namely, $V_1$, $V_3$, $V_6$, and $V_8$, are now opened. During this second stroke, therefore, pressurized cold water will be inletted via open valve $V_1$ into motor chambers $M_1$ and $M_4$ to drive the plungers 124 in those cylinders, and therefore the plungers in the remaining two cylinders, in the reverse direction so as to pump pressurized hot water out of the pump compartments $P_1$ and $P_4$ via open valve $V_3$, while releasing unpressurized cold water to the unpressurized cold water outlet 105 via open valve $V_8$, and drawing in unpressurized hot water from inlet 107 via open valve $V_6$.

Figure 12:
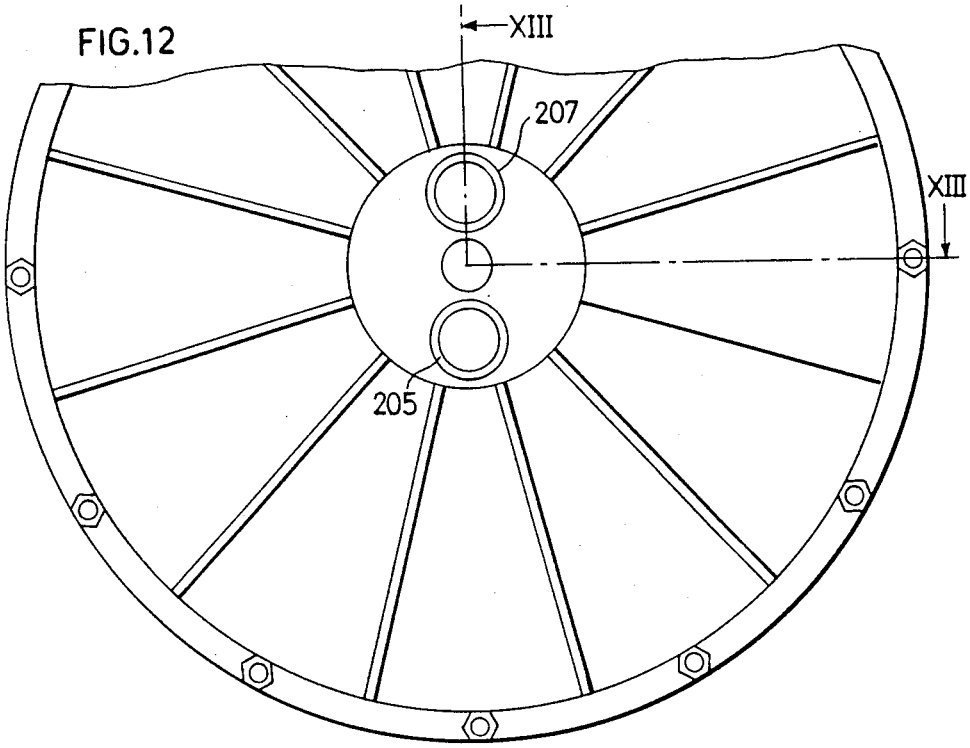
FIG. 12 is a bottom plan view illustrating another motor-pump unit constructed in accordance with the present invention.
Figure 13:
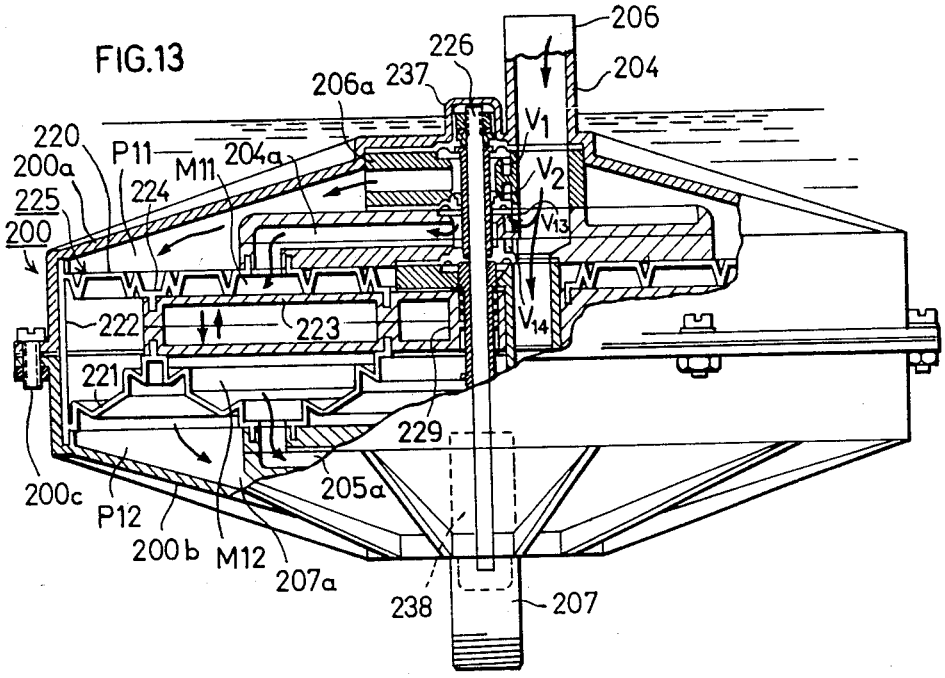
FIG. 13 is a sectional view along lines XIII—XIII of FIG. 12.

FIGS. 12 and 13 illustrate another implementation of the motor-pump unit which may be used in the apparatus illustrated in FIG. 6, where, instead of using four pairs of diagonally-opposed cylinders driven by four pairs of plungers, there are used two pairs of annularly-shaped cylinders driven by two diaphragms connected together by a rigid disc that transmits their movement, via a pair of springs, to a reciprocating member which drives the valves.

More particularly, the motor-pump unit, which is also submerged in an unpressurized tank (not shown) as in FIGS. 6–11, is enclosed within a casing, generally designated 200, made of an upper section **200*a* and a lower section 200*b* secured together, by fasteners 200*c* passing through circumferential flanges at their outer edges. The upper housing section 200*a* includes the pressurized cold-water port 204 and also the pressurized hot-water port 206, and the lower housing section 200*b* includes the unpressurized cold-water port 205 and the unpressurized hot-water port 207**.

A pair of annular diaphragms 220, 221 are coaxially disposed within housing 200 and are secured at their outer extremities to the housing. Actually, as shown in FIG. 13, the two diaphragms 220, 221 may be integrally joined together via an annular wall 222 secured to the inner face of the housing. A rigid disc 223, of smaller outer diameter than the two diaphragms 220, 221, is secured between the two diaphragms, as by fasteners 224 such that elements 221–224 form an integral diaphragm assembly, generally designated 225, which may reciprocate by the resiliency of the outer portions of the two diaphragms 220, 222.

Rigid disc 223 of the diaphragm assembly 225 is coupled to a reciprocating rod 226 via a pair of springs (only one of which is shown at 227 in FIG. 13) interposed between an inner shoulder 229 formed in disc 224 and a corresponding shoulder formed in the reciprocating rod, such that the reciprocation of disc 223 effects the reciprocation of the rod. Rod 226 in turn controls a first group of valve members within a housing 237 at one end of the rod, and a corresponding second group of valve members within another valve housing at the opposite end of the rod, the latter valve housing being shown by broken lines 238 in FIG. 13. As also shown in FIG. 13, the upper valve housing 237 includes four valve members $V_{11}$–$V_{14}$ corresponding to valve numbers $V_1$–$V_4$ in FIG. 7. The lower valve housing 238 also includes four valve members (not shown) corresponding to valve numbers $V_5$–$V_8$ in FIG. 7.

The arrangement is such that the interior of casing 200 is divided into an annular motor chamber and an annular pump chamber on one side of the diaphragm assembly 225, and an annular motor chamber and an annular pump chamber on the opposite side of the diaphragm assembly. In both cases, the motor chamber is the inner annular chamber, and the pump chamber is the outer annular chamber and is coaxial with respect to the motor chamber.

More particularly, on the upper side of the diaphragm assembly 225 illustrated in FIG. 13, the inner annular chamber $M_{11}$ serves as a motor chamber and is defined by the upper face of disc 223 and the inner portion of diaphragm 220 (i.e., the portion inwardly of its securement at 224 to disc 223), this motor chamber being connected via conduit **204*a* and valve members $V_{12}$, $V_{13}$ to the pressurized cold-water inlet 204; and the outer annular chamber $P_{11}$ defined by the outer portion of diaphragm 220 and the inner face of casing section 100*a* serves as a pump chamber and is connected via conduit 206*a* and valve members $V_{11}$, $V_{12}$ to the pressurized water outlet 206. Similarly, on the lower side of the diaphragm assembly 225, the inner annular chamber $M_{12}$ defined by the lower face of disc 223 and inner portion of diaphragm 221, serves as a motor chamber and is connected via a conduit 205*a* and two of the valves (not shown) within valve housing 238, to the unpressurized cold-water outlet 205 (FIG. 12); and the outer annular chamber $P_{12}$, defined by the outer portion of diaphragm 221 and the inner face of casing section 200*b*, serves as a pump chamber and is connected via conduit 207*a* and the remaining two of the four valves in the valve housing 238 to the unpressurized hot water inlet 207**.

It will be seen that the motor-pump unit illustrated in FIGS. 12 and 13 operates in a similar manner as the motor-pump units described earlier. Thus, during one reciprocatory stroke, the pressurized cold water is applied to the inner motor chamber $M_{11}$ via the pressurized cold-water inlet 204, valves $V_{11}$, $V_{12}$, and conduit **204*a*, to drive the diaphragm assembly 225 in one direction (downwardly, in FIG. 13), which causes the pump chamber $P_{12}$ on the opposite side of the diaphragm assembly to pump out the hot water contained in that chamber via conduit 207*a* and two of the valves within the outer valve housing 238 to the pressurized hot-water outlet at 206; and during the return stroke the pressurized cold water is applied from the pressurized cold-water inlet 204 to motor chamber $M_{12}$ at the opposite side of the diaphragm assembly to drive the latter upwardly and to pump out the hot water within pump chamber $P_{11}$ through conduit 206*a* to the hot-water outlet 206**.

As in the previously described embodiments, the volumes of the various chambers are such that the unit delivers about 5% more hot water than the entering cold water, the difference being made up by the float-operated valve arrangement illustrated in FIG. 6.

While the invention has been described with respect to a hot-water supply system in order to avoid the need for a pressurized hot-water storage tank, it will be appreciated that the invention could be used in many other applications to avoid a pressurized construction, for example in heat-exchangers, filters, and the like. It is therefore to be appreciated that the embodiments of the invention illustrated herein are described for purposes of example, and that many other variations, modifications, and applications of the invention may be made.

What is claimed is:

1. A fluid handling system comprising a container including an inlet connectable to a pressurized fluid supply line and an outlet connectable to a pressurized fluid outlet line including a control valve; and a pressure-booster including a motor driven by the inletted fluid when the control valve is open to thereby decrease the pressure of the fluid within the container, and a pump driven by the motor to pump out the fluid from the container at a higher pressure than the pressure of the fluid within the container; characterized in that:

said pressure-booster includes a diaphragm seal positively sealing the inletted fluid from the outletted fluid;

said pump has a greater displacement than said motor such that the operation of the pressure-booster tends to deplete the container; and said system further includes a bypass from the pressurized fluid supply line to the interior of said container bypassing said pressure-booster for replenishing the fluid in the container.

2. The system according to claim 1, wherein said fluid is a liquid forming a free liquid surface in said container; said bypass including a liquid level detector replenishing the liquid depleted from the container to maintain a constant liquid level therein.

3. The system according to claim 1, wherein said diaphragm seal includes a diaphragm between said motor and said pump positively sealing the inletted fluid from the outletted fluid.

4. The system according to claim 3, wherein said pressure-booster includes a housing having a pair of displaceable diaphragms, constituting said diaphragm seal, spaced apart and interconnected by a reciprocating member, said pair of diaphragms dividing the interior of the housing into a central chamber between the two diaphragms and connected to one of said pressurized fluid lines, and a pair of end chambers between the opposite sides of the two diaphragms and the end walls of the housing and connected to the other of said pressurized fluid lines.

5. The system according to claim 4, wherein said central chamber is connected to the pressurized fluid supply line and serves as a motor chamber utilizing the energy of the inletted fluid for driving the diaphragms, and said end chambers are connected to the pressurized fluid outlet line and serve as pump chambers to pump out the fluid, the net volume of said two end chambers being greater than the net volume of said central chamber to provide said greater displacement of the pump with respect to the motor.

6. The system according to claim 5, wherein said housing further includes a first inlet port communicating with said motor chamber for inletting said pressurized fluid from the supply line for driving said reciprocating member;

a first outlet port communicating with said motor chamber for outletting said first fluid after depressurization thereof;

a second inlet port communicating with said two pump chambers for inletting said fluid from the container;

a second outlet port communicating with said two pump chambers for outletting said fluid from the container after pressurization thereof;

and a valve assembly for reciprocating said reciprocatable member by applying the pressurized fluid from said inlet port first against one of said displaceable members for driving it in a first direction, and then against the other of said displaceable members for driving it in the opposite direction.

7. The system according to claim 6, wherein said valve assembly comprises:

an inlet chamber communicating with said inlet port and including end walls formed with a first pair of valve openings therethrough;

an outlet chamber communicating with said outlet port and including end walls formed with a second pair of valve openings therethrough;

a first valve stem in said inlet chamber and carrying a first pair of valve members for opening and closing said valve openings in said inlet chamber; and a second valve stem in said outlet chamber and carrying a second pair of valve members for opening and closing said valve openings in said outlet chamber;

said valve members being carried by their respective valve stems such that when one valve member of each pair is open, the other valve member of the pair is closed, and the valve members of the second pair facing the same displaceable member as the open valve member of the first pair is closed;

said valve stems being coupled to said reciprocating member to be reciprocated thereby.

8. A liquid handling system comprising:

a container including an inlet connectable to a pressurized liquid supply line and an outlet connectable to a pressurized liquid outlet line;

a control valve in said outlet line;

and a pressure-booster including a motor driven by the inletted liquid when the control valve is open to thereby decrease the pressure of the liquid within the container, and a pump driven by the motor to pump out the liquid from the container at a higher pressure than the pressure of the liquid within the container;

said pressure-booster includes a diaphragm seal positively sealing the inletted liquid from the outletted liquid;

said pump having a greater displacement than said motor such that the operation of the pressure-booster tends to deplete the container; and said system further including a bypass from the pressurized liquid supply line to the interior of said container bypassing said pressure-booster for replenishing the liquid in the container.

9. The system according to claim 8, wherein said bypass includes a liquid level detector replenishing the liquid depleted from the container to maintain a constant liquid level therein.

10. The system according to claim 8, wherein said pressure-booster includes a housing having a pair of displaceable diaphragms, constituting said diaphragm seal, spaced apart and interconnected by a reciprocating member, said pair of diaphragms dividing the interior of the housing into a central chamber between the two diaphragms and connected to one of said pressurized liquid lines, and a pair of end chambers between the opposite sides of the two diaphragms and the end walls of the housing and connected to the other of said pressurized liquid lines.

11. The system according to claim 10, wherein said central chamber is connected to the pressurized liquid supply line and serves as a motor chamber utilizing the energy of the inletted liquid for driving the diaphragms, and said end chambers are connected to the pressurized liquid outlet line and serve as pump chambers to pump out the liquid, the net volume of said two end chambers being greater than the net volume of said central chamber to provide said greater displacement of the pump with respect to the motor.

12. The system according to claim 11, wherein said housing further includes:

a first inlet port communicating with said motor chamber for inletting said pressurized liquid from the supply line for driving said reciprocating member;

a first outlet port communicating with said motor chamber for outletting said first liquid after depressurization thereof;

a second inlet port communicating with said two pump chambers for inletting said liquid from the container;

a second outlet port communicating with said two pump chambers for outletting said liquid from the container after pressurization thereof;

and a valve assembly for reciprocating said reciprocatable member by applying the pressurized liquid from said inlet port first against one of said displaceable members for driving it in a first direction, and then against the other of said displaceable members for driving it in the opposite direction.

* * * * *